US007780041B2

(12) United States Patent
Albisetti

(10) Patent No.: US 7,780,041 B2
(45) Date of Patent: Aug. 24, 2010

(54) DEVICE FOR ATOMISING A FLUID PRODUCT

(75) Inventor: Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 615 days.

(21) Appl. No.: 11/510,773

(22) Filed: Aug. 28, 2006

(65) Prior Publication Data

US 2007/0045448 A1 Mar. 1, 2007

Related U.S. Application Data

(60) Provisional application No. 60/713,370, filed on Sep. 2, 2005.

(30) Foreign Application Priority Data

Aug. 26, 2005 (FR) ..... 05 52571

(51) Int. Cl.
*B65D 37/00* (2006.01)

(52) U.S. Cl. ..... 222/211; 222/464.2

(58) Field of Classification Search ..... 222/206, 222/211, 213, 215, 464.2, 631, 632, 633; 239/323, 372, 342
See application file for complete search history.

(56) References Cited

U.S. PATENT DOCUMENTS

| | | | | |
|---|---|---|---|---|
| 2,571,504 | A | 10/1951 | Vuillemenot | |
| 2,642,313 | A | 6/1953 | Montenier | |
| 2,728,981 | A | 1/1956 | Hooper | |
| 2,981,444 | A * | 4/1961 | Root | 222/632 |
| 3,224,648 | A * | 12/1965 | Zimmermann | 222/633 |
| 3,471,064 | A * | 10/1969 | Micallef | 222/211 |
| 4,014,468 | A * | 3/1977 | Silverman et al. | 239/327 |
| 4,091,966 | A | 5/1978 | Laauwe | |
| 4,356,941 | A | 11/1982 | McRoskey et al. | |
| 6,860,404 | B2 | 3/2005 | Duqueroie | |
| 2003/0075554 | A1 * | 4/2003 | Duqueroie | 222/1 |

FOREIGN PATENT DOCUMENTS

| | | |
|---|---|---|
| EP | 1 279 607 | 1/2003 |
| GB | 263 699 | 1/1927 |
| GB | 680 815 | 10/1952 |
| GB | 1 311 086 | 3/1973 |
| WO | WO 2004/067392 | 8/2004 |

* cited by examiner

*Primary Examiner*—Kevin P Shaver
*Assistant Examiner*—Daniel R Shearer
(74) *Attorney, Agent, or Firm*—Oblon, Spivak, McClelland, Maier & Neustadt, L.L.P.

(57) ABSTRACT

A device for atomizing a fluid product includes a reservoir containing the product and air, with the reservoir including a wall having at least one deformable area. A dip tube communicates selectively or permanently with an atomizing aperture to atomize the product when pressure is exerted on the deformable area. According to a preferred example, the dip tube includes at least one air passage to allow at least part of the air contained in the reservoir to mix with the product conveyed by the dip tube. The air passage is located between the two ends of the dip tube. Further, before a first use of the device and in an at least partially deformed position of the deformable area, the at least one air passage is not immersed in the product, regardless of the position of the reservoir.

21 Claims, 3 Drawing Sheets

Fig. 6
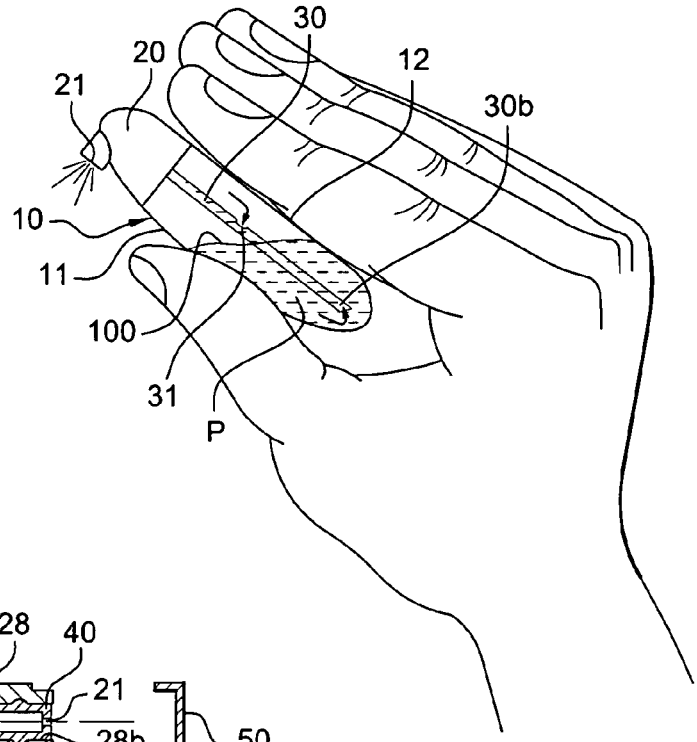
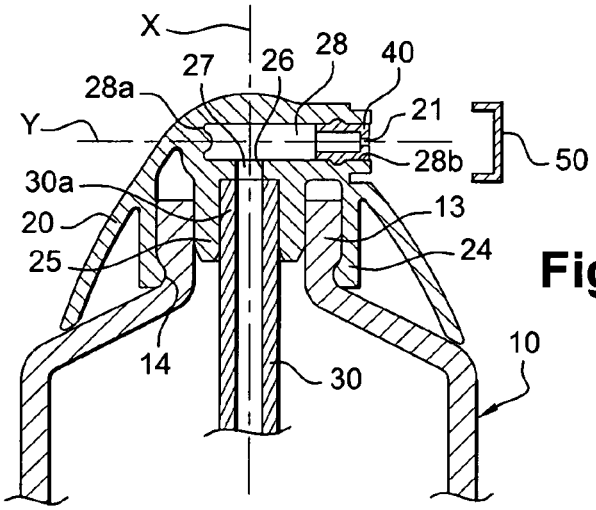
Fig. 7
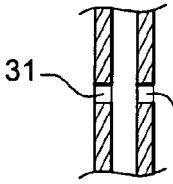
Fig. 8
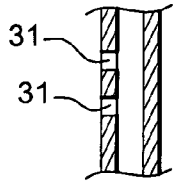
Fig. 9

DEVICE FOR ATOMISING A FLUID PRODUCT

CROSS-REFERENCE TO RELATED APPLICATIONS

This document claims priority to French Application Number 05 52571, filed Aug. 26, 2005 and U.S. Provisional Application No. 60/713,370, filed Sep. 2, 2005, the entire content of which are hereby incorporated by reference.

BACKGROUND OF THE INVENTION

1. Field of the Invention

The present invention concerns a device for atomizing a fluid product. In particular, the invention concerns a small or miniature atomizer which can be used in the packaging of cosmetic products. The invention can be particularly advantageous, for example, for perfumes.

2. Description of Related Art

As sample type devices are not generally intended for sale, their manufacturing cost must be as low as possible. It is therefore important that such devices have parts which can be easily mass-produced and that assembly can be performed simply. In addition, they must be able to generate a good quality spray, and with the characteristics that are as constant as possible.

One solution for producing such packaging at as low a cost as possible could include providing a reservoir in the form of a dispenser of the type commonly used for the packaging of certain physiological saline solutions, eye drops or make-up removal products. A dispenser of this kind is produced in a single piece with an atomizing aperture, the opening of which is created by pulling off an end piece, in particular by twisting the end piece about the axis of the aperture. The filling of a device of this kind can be carried out via an open bottom of the reservoir. The latter is then closed up, for example by welding, in the manner of a tube.

A solution of this kind however suffers from two major drawbacks. The first is due to the fact that, upon opening, the aperture that results from pulling off the end piece by twisting is of imprecise shape and size. As a result, the spray that can be obtained through such an aperture, when the compressible walls of the reservoir are pressed, can have characteristics that vary greatly from one device to another. Often, the section of the aperture is such that it is not possible to generate a spray. The product can only flow out in the form of more or less large drops or a continuous trickle.

In addition, after filling of the reservoir, problems can arise in the welding/closing operation, particularly where a highly volatile product such as a perfume is concerned. Under the effect of the heat, there is a risk of the product evaporating, deteriorating, or perhaps even igniting.

Another solution is described, for example in EP 1 279 607, U.S. Pat. Nos. 2,571,504, 2,642,313, 2,728,981, GB 680 815 and GB 263 699, which use a device of the nebuliser type. The device described in these documents includes a container with a deformable wall which contains a liquid product to be atomized. The container is topped by an atomizer head provided with an atomizing aperture that communicates with the inside of the container by a dip tube. An air inlet is provided in the upper part of the tube or above the tube. When the container is compressed, the internal volume of the container is reduced so that the air is compressed and forces the product from the container. The product then goes up into the dip tube. The compressed air also tends to escape from the container and enters the dip tube via the air inlet. A mixture of air and product is then obtained in the tube before atomization.

However, in certain positions, the air inlet is immersed in product at the same time as the lower end of the dip tube. If the user presses the deformable wall of the reservoir in such a position, the product is dispensed in the form of a jet or trickle and not a good quality spray.

SUMMARY OF THE INVENTION

Therefore, one of the objects of the invention is to implement an atomizing device, wholly or partially solving the problems discussed above with reference to the conventional devices.

Another object of the invention is to implement such a device that is easy to mass produce, with a production cost that is as low as possible.

Another object of the invention is to provide a device of this kind that makes it possible to generate a good quality spray.

The above objects can be achieved by a device for atomizing a fluid product according to the invention. A preferred example includes a reservoir containing the product and air, with the reservoir including a wall having at least one deformable area. A dip tube communicates selectively or permanently (or continuously) with an atomizing aperture that is capable of atomizing the product in response to pressure exerted on the deformable area. The dip tube includes a first end, and a second end, at the opposite end to the first, through which the product can enter. The dip tube also includes at least one air passage for allowing at least part of the air contained in the reservoir to mix with the product conveyed by the dip tube, with the air passage located between the two ends of the dip tube. According to a preferred example, before a first use of the device and in an at least partially deformed position of the deformable area, the at least one air passage is out of the product (it is not immersed), irrespective or regardless of the position of the reservoir. Irrespective or regardless of the position of the reservoir means irrespective of the substantially stationary position of the reservoir. Of course, it is not excluded that, when the reservoir is shaken, product can momentarily reach the level of the air passage.

Because the air passage is never immersed in product, product entering the dip tube is prevented or reduced. Thus, the product does not come out in the form of a poor quality jet without the product being mixed with air. For example, the product will either be atomized in the form of a spray by virtue of the air/product mixture, or air alone will come out depending on whether or not the second end of the tube is immersed in product.

By way of example, the air passage is preferably out of the product when the deformable area is deformed to its maximum, under normal conditions of use.

The second end of the dip tube can be located in the vicinity of the bottom of the reservoir so that most of the product contained in the reservoir can be dispensed.

Also by way of example, the dip tube can include more than one air passage, when it is desired for example to obtain a more aerated spray. The dip tube can for example include two air passages located opposite one another. The dip tube can also include at least two air passages situated at two or more different heights.

The cross-section of the air passage or passages can be circular, but it can also be oval, triangular, polygonal or any other shape. When the dip tube includes two or more air passages, they can have identical or different shapes or cross-sections.

By way of example, the air passage can open out facing a portion of the wall of the reservoir located at the opposite side from the deformable area. Thus, when the wall of the reservoir is pressed, the volume of the reservoir is reduced at the side opposite to the air passage which avoids the product being brought to the level of the air passage.

According to an example, the atomizing aperture can open out along an axis that is oblique with respect to the axis of the dip tube. The atomizing aperture can also open out along an axis substantially perpendicular to the longitudinal axis of the dip tube. As the device is preferably used with its top upwards with the tube substantially vertical, one may thus obtain a spray which is not vertical. For example, a horizontal spray can be provided which facilitates the application of the product on the skin by providing, for example, an atomizing aperture oriented at 90° with respect to the axis of the dip tube.

Advantageously, the deformable area of the wall preferably has shape memory, that is to say it is configured so as to resume its initial shape by elastic return when the pressure ceases. The device can then be used several times consecutively.

The deformable area can have, for example, a substantially convex profile in its non-deformed position, for example in the shape of a dome, and a substantially concave profile in its deformed position. This configuration facilitates the return of the wall to the convex position when the pressure ceases. The wall located opposite the deformable area can be substantially flat for example.

Further by way of example, the deformable area of the reservoir can be formed from a thermoplastic material, in particular polyethylene, polypropylene, polyester terephthalate, polyethylene naphthalate, polyacrylonitrile, polyoxymethylene, polyvinyl chloride, or a mixture of these materials.

The device can include an atomizing end piece fixed to the reservoir which includes the atomizing aperture.

The atomizing device can also include a closure member capable of closing off the atomizing aperture.

The device is particularly advantageous for the packaging and atomizing of a sample measure of a cosmetic product, particularly a perfume.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

FIGS. 1 to 6 illustrate perspective views of one embodiment of the atomizing device according to the invention, in different positions;

FIG. 7 partially depicts in axial cross-section the atomizing device illustrated in FIG. 1;

FIGS. 8 and 9 partially illustrate variant embodiments of the dip tube of the device of FIG. 1;

DETAILED DESCRIPTION OF THE PREFERRED EMBODIMENTS

Figure 1:
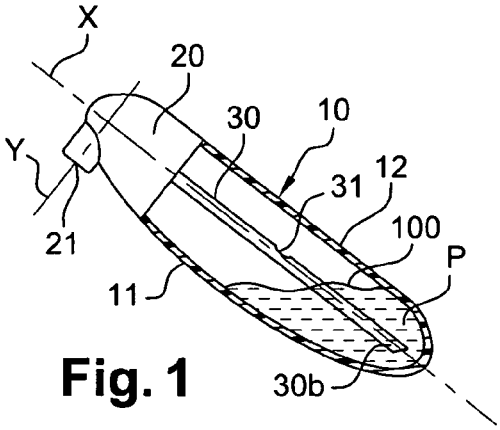

Referring now to the drawings, like reference numerals are utilized to designate identical or corresponding parts throughout the several views.

The device depicted in overview in the example of FIGS. 1 to 6 includes a reservoir 10 with a deformable wall, containing the product P to be dispensed and air. An end piece 20 includes an atomizing aperture 21 and is mounted on the reservoir. The atomizing aperture 21 is in communication with the inside of the reservoir by a dip tube 30 having a longitudinal axis X.

According to the illustrated example, the reservoir 10 has as shaped of a drop of water, however it is to be understood that it can have any other shape permitting the deformation of at least one of its walls. It can for example be in the shape of a sphere.

The reservoir 10 is obtained, for example, by moulding, in particular by injection blow moulding from a single piece, of a thermoplastic material. The reservoir is, for example, formed from polyethylene, polypropylene, polyethylene terephthalate, polyethylene naphthalate, polyacrylonitrile, polyoxymethylene, polyvinyl chloride, or a mixture of these materials.

The wall of the reservoir 10 includes an area 11 having, for example, a rounded shape which is deformable when pressure is exerted on it. This wall preferably has shape memory so that it resumes its initial position when pressure is no longer exerted on it.

At the opposite side to this area 11, the reservoir 10 has a flat wall 12 in the illustrated example. This configuration of the reservoir makes it possible to easily identify the area on which the user should exert pressure so that operation of the device is easily recognizable. In addition, this configuration makes it possible to easily hold the device between two fingers. Furthermore, the flat wall 12 can also be advantageous for holding the device in a stable position when it is set down on a surface. The flat wall 12 can also easily be decorated or provided with other indicia if desired.

The reservoir 10 ends with an open neck 13 in the illustrated example, visible in FIG. 7, on which the atomizing end piece 20 is mounted so as to be leak proof. The external shape of the atomizing end piece 20 is such that, when the end piece is fixed on the reservoir neck, it forms the end of the water drop shape. By way of example, the atomizing end piece 20 includes an attachment skirt 24, cylindrical or a shape generated by revolution, which cooperates by latching with an annular groove 14 formed on the external wall of the neck 13 of the reservoir.

The atomizing end piece 20 also includes a sealing skirt 25, for example cylindrical or a shape generated by revolution, with the sealing skirt being concentric with the attachment skirt 24. The sealing skirt 25 rests in a leak proof manner on the internal surface of the neck 13 of the container. The attachment skirt 24 and the sealing skirt 25 extend parallel to the longitudinal axis X of the dip tube.

A wall 26, transverse to the axis X, partially closes up the sealing skirt 25 in its upper part. The transverse wall 26 includes a passage 27 that opens out in a duct 28 with longitudinal axis Y, perpendicular to the axis X in the illustrated example. The duct 28 is closed at one of its ends 28*a*, and open at the other of its ends 28*b* in order to receive a nozzle 40 in which the atomizing aperture 21 is formed.

The dip tube 30 is press-fitted into the atomizing end piece 20. For example, the first end 30*a* of the dip tube is press-fitted into the sealing skirt 25. The second end 30*b* of the dip tube opens out substantially towards the bottom of the reservoir so as to be immersed in the product to be atomized when the atomizing device is in the top-upwards position.

An aperture 31 is formed in the lateral wall of the dip tube 30 to allow the air present in the reservoir 20 above the product to be used to provide an atomized spray, when the reservoir is compressed, with the air introduced into the dip tube at the same time as the product goes up into the tube, as depicted in FIG. 6.

The position of the air passage 31 is chosen according to the shape of the reservoir and the initial amount of product, so that, before a first use of the device, the air passage 31 is out of the product, irrespective or regardless of the position of the reservoir.

In particular, when the device is in the top-upwards position, that is to say when the second end 30*b* of the dip tube is below the first 30*a*, it can be seen in FIGS. 1 and 2 that the upper level 100 of the product is below the air passage 31. Preferably, when the device is in the top-downwards position, that is to say when the second end 30*b* of the dip tube is above the first end 30*a*, it can be seen in FIGS. 4 and 5 that the upper level 100 of the product is still below the air passage 31. Similarly, when the dip tube is horizontal as depicted in FIG. 3, the upper level 100 of the product is below the air passage 31. Also, the air passage 31 is preferably out of the product when the deformable area 11 is deformed to its maximum as depicted in FIG. 6.

According to one particular example, if a sphere-shaped reservoir is used, the air aperture is placed at the center of the sphere and the reservoir is filled with a volume of product less than half the total volume of the reservoir.

Figure 2:
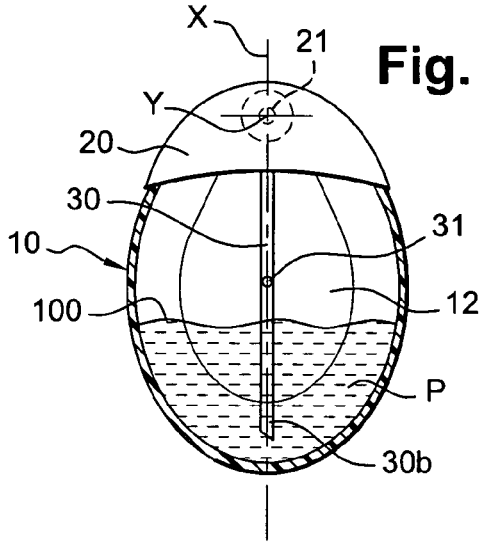
Figure 3:
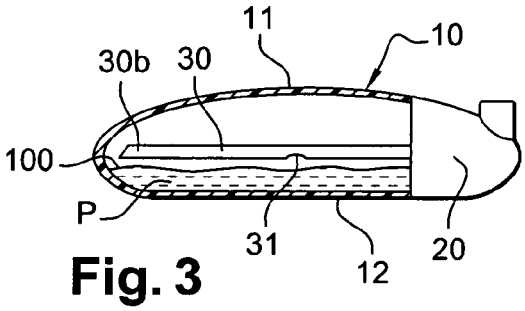

In the positions illustrated in FIGS. 1, 2 and 6, the lower end 30*b* of the dip tube 30 is immersed in the product. The product can then be atomized by pressing the deformable wall 11 as illustrated in FIG. 6. The reservoir 10 then changes from a convex first position, corresponding to its non-deformed position, to a concave second position corresponding to its deformed position. The rest of the reservoir is substantially not deformed so that, when the deformable wall 11 is deformed, the internal volume of the reservoir decreases. The air present in the reservoir is then compressed and an excess pressure is created inside the reservoir. The product is pushed inside the dip tube, through its end 30*b*, at the same time as the air is introduced therein, via the air passage 31, so that a product/air mixture is formed in the dip tube. The mixture obtained is then atomized through the aperture 21.

When the wall resumes its initial shape, air then enters the reservoir, for example, through the atomizing aperture 21. If some product remains inside the reservoir, excess pressure can again be created by deforming the activating wall and thus another measure of the product can be atomized.

Figure 4:
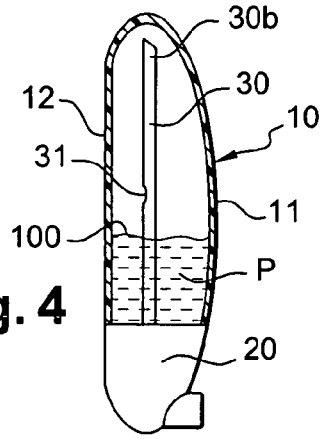
Figure 5:
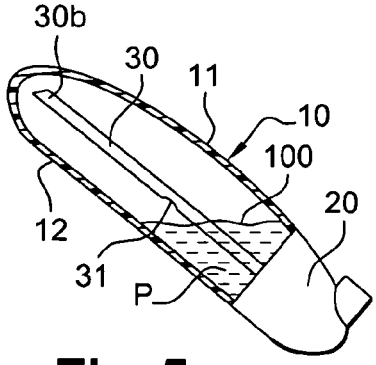

In the positions illustrated in FIGS. 3 to 5, the lower end 30*b* of the dip tube is no longer immersed in the product. Given that the air passage 31 is also out of the product, if the user presses the deformable wall 11, only air will come out. They will then know that they must position the reservoir differently to be able to atomize product.

According to the invention, as the lower end 30*b* of the dip tube and the air passage 31 are never both immersed in product, the user can avoid discharge of the product in the form of a jet or stream. Either the product will be atomized in the form of a spray by virtue of the air/product mixture, or air alone will come out.

Figure 10A:
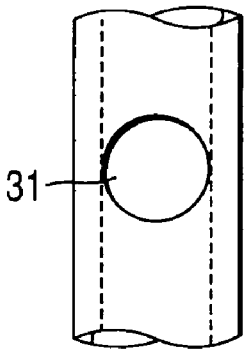
FIG. 10A illustrates an circular cross-section embodiment of an air passage within the dip tube as viewed from the front of the air passage.
Figure 10B:
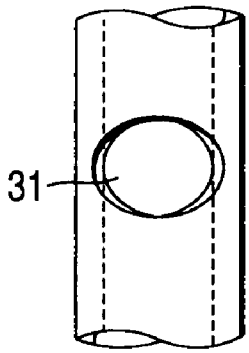
FIG. 10B illustrates an oval cross-section embodiment of the air passage within the dip tube as viewed from the front of the air passage.
Figure 10C:
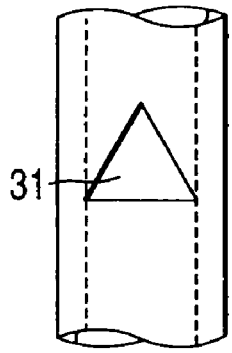
FIG. 10C illustrates a triangular cross-section embodiment of the air passage as viewed from the front of the air passage.
Figure 11A:
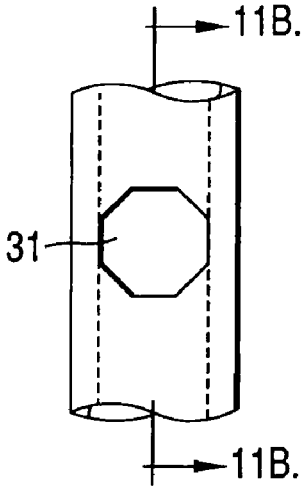
FIG. 11A illustrates a polygonal cross-section embodiment of the air passage as viewed from the front of the air passage.
Figure 11B:
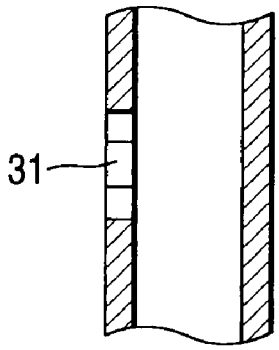
FIG. 11B illustrates the polygonal cross-section embodiment of the air passage of FIG. 11A as viewed from a side.

In the example just described, the air passage is a hole of circular cross section as illustrated in FIG. 10A. As shown for example in FIGS. 10B-10C and 11A-11B, the air passage can be formed by a hole of any other shape, for example a hole of oval, triangular or polygonal cross-section.

In addition, the dip tube can include several air passages 31. The dip tube can for example include two air passages located opposite one another as illustrated in FIG. 8, or two air passages 31 located at two different heights as depicted in FIG. 9. Preferably, all the air passages will remain out of the product, irrespective or regardless of the position of the reservoir.

In order that the atomizing device can be better stored between two uses, the atomizing end piece 20 can include a closure member 50, in the form for example of a cap that is fixed on the outside of the nozzle 40 as seen in FIG. 7.

In a variant, provision can be made for the atomizing aperture to be closed off before a first use, for example by means of a heat-sealed film, for example, one which cannot be repositioned after having been removed. An arrangement of this kind is adapted to single-use atomizing devices.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for atomizing a fluid product, comprising:

a reservoir containing the fluid product and air, the reservoir including a wall having at least one deformable area;

a dip tube which communicates selectively or permanently with an atomizing aperture that atomizes the fluid product in response to pressure exerted on the deformable area, wherein the dip tube comprises:

a first end to guide the fluid product from the dip tube to the atomizing aperture;

a second end, disposed at an end opposite the first end, through which the fluid product enters the dip tube from the reservoir; and an air passage that allows at least part of the air contained in the reservoir to mix with the product conveyed by the dip tube, the air passage being positioned between the first end and the second end of the dip tube such that when the fluid product is initially filled in the reservoir, a volume of the reservoir below the air passage is greater than a volume of the fluid in all positions of the reservoir.

2. A device according to claim 1, wherein the air passage is not immersed in the fluid product when the deformable area is deformed to a maximum of the deformable area.

3. A device according to claim 1, wherein the second end is positioned near a bottom of the reservoir.

4. A device according to claim 1, wherein the air passage opens out facing a portion of the wall of the reservoir at a side opposite the deformable area.

5. A device according to claim 1, wherein the dip tube includes two air passages located on opposite sides of the tube relative to a longitudinal axis of the dip tube.

6. A device according to claim 1, wherein the dip tube includes at least two air passages positioned at a plurality of different heights between the first end at a top of the reservoir and the second end at the bottom of the reservoir.

7. A device according to claim 1, wherein the dip tube includes two air passages having different cross-sections.

8. A device according to claim 1, wherein the atomizing aperture opens out along an axis that is oblique with respect to a longitudinal axis of the dip tube.

9. A device according to claim 1, wherein the atomizing aperture opens out along an axis substantially perpendicular to a longitudinal axis of the dip tube.

10. A device according to claim 1, wherein the deformable area resumes an initial shape of the deformable area by elastic return when the pressure ceases.

11. A device according to claim 1, wherein the deformable area has a substantially convex profile in a non-deformed position, and a substantially concave profile in a deformed position.

12. A device according to claim 11, wherein a wall positioned opposite the deformable area is substantially flat.

13. A device according to claim 1, wherein the deformable area of the reservoir is formed from at least one of polyethylene, polypropylene, polyethylene terephthalate, polyethylene naphthalate, polyacrylonitrile, polyoxymethylene, polyvinyl chloride, and mixtures of the foregoing materials.

14. A device according to claim 1, wherein the device includes an atomizing end piece fixed to the reservoir and which includes the atomizing aperture.

15. A device according to claim 1, further comprising a closure member capable of closing off the atomizing aperture.

16. A device according to claim 1, wherein the fluid product in said reservoir is a cosmetic product.

17. A device according to claim 1, wherein the fluid product in said reservoir is a perfume.

18. A device according to claim 1, wherein the at least one air passage includes two air passages, and neither of said two air passages are immersed in said fluid product when the fluid product is initially filled in the reservoir in all positions of the reservoir.

19. A device according to claim 18, wherein said two air passages extend transversely through a side wall of said dip tube.

20. A device according to claim 1, wherein said air passage extends transversely through a side wall of said dip tube.

21. A device according to claim 1, wherein, in a vertical position of the device with the first end of the dip tube above the second end, a level of the fluid product is at least at a level of the second end of the dip tube when the product is initially filled in the reservoir tube.

* * * * *